US009924282B2

(12) United States Patent
Ell et al.

(10) Patent No.: US 9,924,282 B2
(45) Date of Patent: Mar. 20, 2018

(54) SYSTEM, HEARING AID, AND METHOD FOR IMPROVING SYNCHRONIZATION OF AN ACOUSTIC SIGNAL TO A VIDEO DISPLAY

(75) Inventors: Søren C. Ell, Roskilde (DK); Jesper L. Nielsen, Ringsted (DK)

(73) Assignee: GN RESOUND A/S, Ballerup (DK)

( * ) Notice: Subject to any disclaimer, the term of this patent is extended or adjusted under 35 U.S.C. 154(b) by 509 days.

(21) Appl. No.: 13/355,189

(22) Filed: Jan. 20, 2012

(65) Prior Publication Data

US 2013/0170654 A1 Jul. 4, 2013

(30) Foreign Application Priority Data

Dec. 30, 2011 (DK) ..... 2011 70775

(51) Int. Cl.
*H04R 5/00* (2006.01)
*H04R 25/00* (2006.01)

(52) U.S. Cl.
CPC ..... *H04R 25/554* (2013.01); *H04R 25/552* (2013.01); *H04R 2225/55* (2013.01); *H04R 2225/61* (2013.01)

(58) Field of Classification Search
CPC ..... H04R 25/552; H04R 2225/55
See application file for complete search history.

(56) References Cited

U.S. PATENT DOCUMENTS 5,751,694 A 5/1998 Toft
5,794,201 A * 8/1998 Nejime et al. ..... 704/267
2003/0231871 A1* 12/2003 Ushimaru ..... 386/96
2005/0069162 A1 3/2005 Haykin et al.
2005/0238190 A1* 10/2005 Rohrlein ..... 381/312
2007/0009124 A1* 1/2007 Larsen ..... 381/315
(Continued)

FOREIGN PATENT DOCUMENTS

EP 2 071 849 A1 6/2009
EP 2 107 825 A1 7/2009
(Continued)

OTHER PUBLICATIONS

Office Action for JP Patent Application No. 2012-282182 dated Feb. 4, 2014 (5 pages).
(Continued)

*Primary Examiner* — Joseph Saunders, Jr.
*Assistant Examiner* — James Mooney
(74) *Attorney, Agent, or Firm* — Vista IP Law Group, LLP

(57) ABSTRACT

A system for improving synchronization of an acoustic signal to a video display includes a hearing aid comprising a hearing loss processor configured for signal processing in accordance with a hearing loss of a user of the hearing aid, the hearing aid being configured for receiving a first audio signal for synchronous presentation to the user viewing the video display, the hearing aid being configured for generating a first acoustic signal to be presented to the user of the hearing aid, the first acoustic signal comprising at least a first part being generated in response to the first audio signal. The system also includes a delay unit configured for applying a delay, such that synchronization of the at least first part of the first acoustic signal to the video display is improved.

23 Claims, 6 Drawing Sheets

(56) References Cited

U.S. PATENT DOCUMENTS

| | | | | |
|---|---|---|---|---|
| 2008/0049957 | A1* | 2/2008 | Topholm | H04R 25/558 381/315 |
| 2011/0142268 | A1* | 6/2011 | Iwakuni et al. | 381/312 |
| 2012/0013721 | A1* | 1/2012 | Nishio et al. | 348/61 |
| 2012/0063610 | A1* | 3/2012 | Kaulberg et al. | 381/71.1 |
| 2012/0154679 | A1* | 6/2012 | Pendarvis | 348/512 |
| 2012/0225645 | A1* | 9/2012 | Sivan | G08C 17/02 455/418 |

FOREIGN PATENT DOCUMENTS

| | | | |
|---|---|---|---|
| JP | 2005184563 | | 7/2005 |
| JP | 2012005005 | | 1/2012 |
| WO | 2010/109745 | A1 | 9/2010 |
| WO | 2010/146734 | A1 | 12/2010 |

OTHER PUBLICATIONS

Extended European Search Report dated Aug. 29, 2012, for EP Patent Application No. 12166569.9.
First Office Action dated Jul. 6, 2012 for Danish Patent Application No. PA 2011 70775.

* cited by examiner

SYSTEM, HEARING AID, AND METHOD FOR IMPROVING SYNCHRONIZATION OF AN ACOUSTIC SIGNAL TO A VIDEO DISPLAY

RELATED APPLICATION DATA

This application claims priority to, and the benefit of, Danish patent application No. PA 2011 70775, filed on Dec. 30, 2011, pending, the entire disclosure of which is expressly incorporated by reference herein.

FIELD

The present application relates to the field of hearing aids. More in particular, the present application relates to presentation of an acoustic signal to a user of a hearing aid, which acoustic signal is accompanying (or is intended to be accompanied by) concurrent display of video.

BACKGROUND

When a user of a hearing aid is using a media system (such as a TV) for presentation/display of audio and video, the user of the hearing aid may receive the audio from the system via a microphone of the hearing aid. This may reduce the quality of the audio as perceived by the user of the hearing aid.

SUMMARY

The inventors have realized that an audio signal (e.g. such as may be streamed from an audio output, such as RCA phone connector, of a TV) may not be in sync with a corresponding video display by the TV. In particular, the audio signal may be in advance in time compared to the video display. This off-sync (out of sync) may e.g. at least partly be due to the processing (e.g. encoding) that is carried out in order to generate a video signal and an audio signal, respectively. Thus, the processing of the signals may not result in a synchronized generation (e.g. stream) of the video signal and the audio signal, respectively. The processing of the video stream may be more complex and may therefore take longer than the processing of the audio stream.

The inventors have noticed that if the video and audio presentations are too far off-sync, e.g. more than about 40 ms, it may be a noticeable and disturbing factor for the user (i.e. the viewer and listener).

Thus, the inventors have realized that there is a need for providing specific solutions for a hearing aid, for a system comprising a hearing aid, and for a method comprising utilization of a hearing aid for provision of improved synchronization between the presentations of inter-related audio and video signals.

According to a first aspect, there is provided a system for improving synchronization of an acoustic signal to a video display. The system comprises a hearing aid and a delay unit that may be integrated in the hearing aid. The hearing aid comprises a hearing loss processor configured for processing in accordance with a hearing loss of a user of the hearing aid. The hearing aid is configured for receiving a first audio signal intended for synchronous (i.e. at least substantially synchronous) presentation to a viewer of the video display. The hearing aid is configured for generating a first acoustic signal to be presented to the user of the hearing aid. The first acoustic signal comprises at least a first part being generated in response to the first audio signal. The delay unit is configured for applying a delay, such that synchronization of the at least first part of the first acoustic signal to the video display is improved.

According to a second aspect, there is provided a hearing aid configured for improving synchronization of an acoustic signal to a video display. The hearing aid comprises a hearing loss processor configured for processing in accordance with a hearing loss of a user of the hearing aid. The hearing aid is configured for receiving a first audio signal being intended for synchronous (i.e. at least substantially synchronous) presentation to a viewer of the video display. The hearing aid is configured for generating a first acoustic signal to be presented to the user of the hearing aid. The first acoustic signal comprises at least a first part being generated in response to the first audio signal. The hearing aid comprises a delay unit configured for applying a delay, such that synchronization of the at least first part of the first acoustic signal to the video display is improved.

According to a third aspect, there is provided a method for improving synchronization of an acoustic signal to a video display. The method comprises receiving a first audio signal by a hearing aid. The first audio signal is intended for synchronous (i.e. at least substantially synchronous) presentation to a viewer of the video display. The hearing aid comprises a hearing loss processor configured for processing in accordance with a hearing loss of a user of the hearing aid. The method comprises generating a first acoustic signal by the hearing aid. The first acoustic signal is presented to the user of the hearing aid. The first acoustic signal comprises at least a first part being generated in response to the first audio signal. The method comprises applying a delay, such that synchronization of the at least first part of the first acoustic signal to the video display is improved.

It is an advantage of one or more embodiments described herein that drawbacks of the prior art are reduced. In particular it is an advantage of the improvement of the synchronization according to one or more embodiments described herein that the user experience may be improved in that less off-sync may be experienced by the user and therefore fewer disturbances and/or inconveniences may be experienced by the user.

In accordance with some embodiments, a system for improving synchronization of an acoustic signal to a video display includes a hearing aid comprising a hearing loss processor configured for signal processing in accordance with a hearing loss of a user of the hearing aid, the hearing aid being configured for receiving a first audio signal for synchronous presentation to the user viewing the video display, the hearing aid being configured for generating a first acoustic signal to be presented to the user of the hearing aid, the first acoustic signal comprising at least a first part being generated in response to the first audio signal. The system also includes a delay unit configured for applying a delay, such that synchronization of the at least first part of the first acoustic signal to the video display is improved.

In accordance with other embodiments, a hearing aid configured for improving synchronization of an acoustic signal to a video display includes a hearing loss processor configured for signal processing in accordance with a hearing loss of a user of the hearing aid, the hearing aid being configured for receiving a first audio signal being for synchronous presentation to the user viewing the video display, the hearing aid being configured for generating a first acoustic signal to be presented to the user of the hearing aid, the first acoustic signal comprising at least a first part being generated in response to the first audio signal. The hearing aid also includes a delay unit configured for applying a delay, such that synchronization of the at least first part of the first acoustic signal to the video display is improved.

In accordance with other embodiments, a method for improving synchronization of an acoustic signal to a video display includes receiving a first audio signal by a hearing aid, the first audio signal being for synchronous presentation to a user of the hearing aid viewing the video display, the hearing aid comprising a hearing loss processor configured for signal processing in accordance with a hearing loss of the user of the hearing aid. The method also includes generating a first acoustic signal by the hearing aid, the first acoustic signal being presented to the user of the hearing aid, the first acoustic signal comprising at least a first part being generated in response to the first audio signal. The method also includes applying a delay, such that synchronization of the at least first part of the first acoustic signal to the video display is improved.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in the scope of the claimed invention.

DETAILED DESCRIPTION

Figure 1:
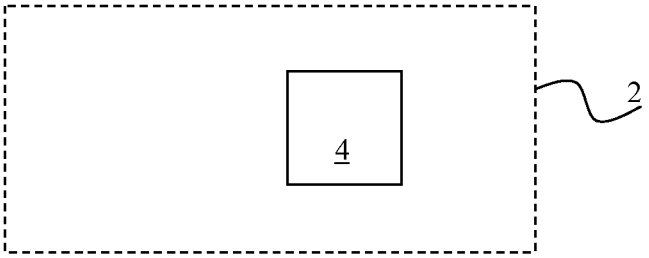
FIG. 1 schematically illustrates a first embodiment of a system.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. It should be noted that in addition to the exemplary embodiments shown in the accompanying drawings, the claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The hearing aid may comprise one or more microphones, e.g. a first microphone and/or a second microphone for reception of acoustic signal(s) and generation of corresponding audio signal(s).

The hearing aid may comprise an analogue-to-digital (AD) converter unit for converting the audio signal(s), which have been generated by the one or more microphones, to digital signal(s). The AD converter unit may be embedded in the hearing loss processor or may form part of the microphone.

The hearing aid may comprise a memory unit. The memory unit may be connected to or may be incorporated in (form part of) the hearing loss processor. The memory unit may be configured for storing data and/or hearing aid parameters, such as configured for storing data for generation of the delay.

The hearing aid may comprise a communication unit that may be configured for receiving and/or transmitting signals, for example radio signals wirelessly, e.g. in order to enable the hearing aid to communicate wirelessly with another device, such as a hearing device and/or a wireless interface. The communication may be one-way. The communication unit may be configured for receiving the first audio signal.

The hearing aid may comprise a digital-to-analogue (DA) converter unit. The DA converter unit may be incorporated into the hearing loss processor.

The hearing aid may comprise a receiver (may also be denoted speaker or loudspeaker) configured for generating the first acoustic signal to the user.

The one or more microphones may be connected to or integrated with the AD converter unit. The AD converter unit may be connected to or integrated with the hearing loss processor. The AD converter unit may convert or transform audio signals from the one or more microphones and send a corresponding digital audio signal to the hearing loss processor. The hearing loss processor may send control signals to the AD converter unit to configure and control operation of the AD converter unit. The hearing loss processor may be connected to a user interface. The receiver may be connected to the hearing loss processor and/or the DA converter. The communication unit may be connected to the hearing loss processor.

The first acoustic signal may comprise a second part generated in response to a signal received by at least one microphone (e.g. of the hearing aid), which signal may be processed (e.g. by the hearing loss processor) in accordance with a hearing loss of the user of the hearing aid. The first and second part of the first acoustic signal may be mixed and presented simultaneously to the user, i.e. presented as a combined signal.

The delay unit may be incorporated by the hearing loss processor.

A Bluetooth protocol or a similar or anther protocol or dedicated protocol may be used for wireless communication via the communication unit. For instance, communication of the first audio signal to the hearing aid may be by wireless communication.

According to one or more embodiments, signals that are intended for synchronous presentation includes signals that are intended for at least substantially synchronous presentation, such as known from a motion picture with an inter-related sound signal.

The first audio signal may be an electromagnetic signal representing a sound signal. The first acoustic signal may be a sound signal. A sound signal may be defined as a signal in form of a mechanical wave that is an oscillation of pressure transmitted through the medium in the ear of the user of hearing aid (which medium is usually air), wherein the signal is comprises frequencies within the range of hearing of the user of the hearing aid and of a level sufficiently strong to be heard by the user of the hearing aid.

The system may comprise a control interface configured for enabling the user of the hearing aid to control the delay. Control of the delay may include adjustment and/or setting of the delay. Provision of the control interface may improve the user experience since the delay may be controlled according to current individual needs and/or habits.

The control interface may comprise one or more push buttons.

The control interface (or another user interface) may be configured for enabling the user of the hearing aid to control the volume of the first acoustic and/or of the first part of the acoustic signal and/or of the second part of the acoustic signal.

The control interface may form part of the hearing aid. Having the control interface forming part of the hearing aid may facilitate the control since the control will always be at the user of the hearing aid.

The control interface may form part of an auxiliary device configured for remote control of the delay. The auxiliary device may comprise a hearing aid remote control and/or a smart phone or pda etc. Having the control interface forming part of an auxiliary device may enable an improved user-friendly experience and/or a detailed control.

The system may be configured for provision of automatic control of the delay by improving synchronization of the at least first part of the first acoustic signal to a second acoustic signal received by at least one microphone of the system, such as at least one microphone of the hearing aid. That is, a signal generated by the at least one microphone of the hearing aid (i.e. generated from the second acoustic signal) may be used for comparing with the first acoustic signal (or a signal derived there from). This may be an advantage if a version of the signal that is intended for synchronous presentation is provided acoustically to the hearing aid, e.g. via a speaker of a TV-set. Provision of automatic control may improve user-friendliness since it may alleviate and/or reduce the needed interaction (e.g. control) by the user of the hearing aid.

The automatic control may be configured to be overruled by interaction by the user via the control interface.

The automatic control may be configured to be activated and/or deactivated by the user, e.g. via the control interface.

The delay may comprise a preset value. Provision of a preset value may improve user-friendliness since it may alleviate the needed interaction (e.g. control) by the user of the hearing aid.

The system may comprise an intermediate unit configured for receiving a second audio signal intended for synchronous presentation to a viewer of the video display. The intermediate unit may be configured for transmitting the first audio signal in response to the received second audio signal. Thus, the aim of the intermediate unit may be to provide the first audio signal in a form (e.g. protocol) that is intended (or at least usable) for a hearing aid.

The delay unit may form part of the intermediate unit. Having the delay unit forming part of the intermediate unit may reduce or eliminate the need for the hearing aid to provide any delay The delay unit may form part of the hearing aid. This may improve the usability of the system and/or the hearing aid, since the hearing aid then is configured for receiving a signal that needs to be delayed in order to reduce discomfort caused by an off-sync signal.

Having both the delay unit and the control interface forming part of the hearing aid may reduce the need for transmission of signals The system may comprise a second delay unit. For instance the delay unit may form part of the hearing aid and the second delay unit may form part of the intermediate unit.

The system may comprise a binaural hearing aid system including the hearing aid and a second hearing aid. At least one of the hearing aids of the binaural hearing aid system may be configured for applying a delay such as both of them. Alternatively, or additionally a delay may be applied to the first audio signal, i.e. a delay is included in the signal received by the hearing aids.

Control of delay/delays for a binaural hearing aid system may be by means of a common control interface, e.g. a control interface forming part of one of the hearing aids or forming part of an auxiliary device.

The delay may be controllable by the user. Having the delay controllable may improve the user experience since the delay may be controlled according to current individual needs and/or habits of the user.

The delay may be controllable in steps of at least 2 ms, such as at least 5 ms, such as at least 10 ms, such as at least 15 ms, such as at least 20 ms, such as at least 25 ms. Having a step of a large time scale may reduce the needed interaction with the control interface. Having a step of a low time scale may improve the option to fine-tune the delay.

The method may comprise automatic control of the delay by improving synchronization of the at least first part of the first acoustic signal to a second acoustic signal received by at least one microphone, such as at least one microphone of the hearing aid.

The system and/or the hearing aid according to one or more embodiments may be configured for carrying out the method according to one or more embodiments.

In the following figures, a connecting line may indicate that a transfer of a signal will or may take place between the connected parts.

FIG. 1 schematically illustrates a first embodiment of a system 2 for improving synchronization of an acoustic signal to a video display (the video display is not illustrated). The system 2 comprises a hearing aid 4 and a delay unit (not illustrated in FIG. 1) that may be integrated in the hearing aid 4. The hearing aid 4 comprises a hearing loss processor (not illustrated in FIG. 1) configured for processing in accordance with a hearing loss of a user of the hearing aid 4. The hearing aid 4 is configured for receiving a first audio signal intended for synchronous (i.e. at least substantially synchronous) presentation to a viewer of the video display. The hearing aid 4 is configured for generating a first acoustic signal to be presented to the user of the hearing aid 4. The first acoustic signal comprises at least a first part being generated in response to the first audio signal. The delay unit is configured for applying a delay, such that synchronization of the at least first part of the first acoustic signal to the video display is improved.

Figure 2:
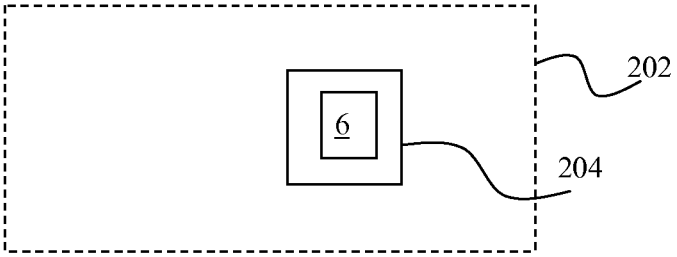
FIG. 2 schematically illustrates a second embodiment of a system.

FIG. 2 schematically illustrates a second embodiment of a system 202 for improving synchronization of an acoustic signal to a video display (the video display is not illustrated). The system 202 comprises a hearing aid 204 and a delay unit 6 that forms part of the hearing aid 204. The hearing aid 204 comprises a hearing loss processor (not illustrated in FIG. 2) configured for processing in accordance with a hearing loss of a user of the hearing aid 204. The hearing aid 204 is configured for receiving a first audio signal intended for synchronous (i.e. at least substantially synchronous) presentation to a viewer of the video display. The hearing aid 204 is configured for generating a first acoustic signal to be presented to the user of the hearing aid 204. The first acoustic signal comprises at least a first part being generated in response to the first audio signal. The delay unit 6 is configured for applying a delay, such that synchronization of the at least first part of the first acoustic signal to the video display is improved.

Figure 3:
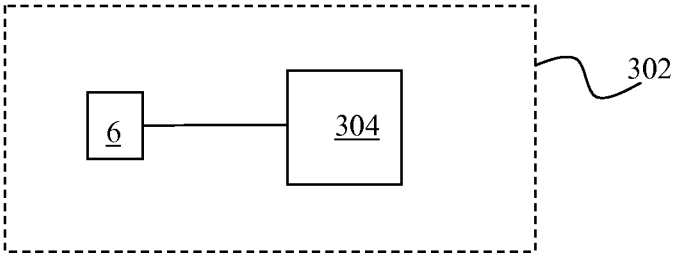
FIG. 3 schematically illustrates a third embodiment of a system.

FIG. 3 schematically illustrates a third embodiment of a system 302 for improving synchronization of an acoustic signal to a video display (the video display is not illustrated). The system 302 comprises a hearing aid 304 and a delay unit 6. The system 302 is configured such that an output from the delay unit 6 may be received by the hearing aid 304 either directly or via another device. The hearing aid 304 comprises a hearing loss processor (not illustrated in FIG. 3) configured for processing in accordance with a hearing loss of a user of the hearing aid 304. The hearing aid 304 is configured for receiving a first audio signal intended for synchronous (i.e. at least substantially synchronous) presentation to a viewer of the video display. The system 302 is configured such that the first audio signal may be received by the hearing aid 304 via the delay unit 6. The hearing aid 304 is configured for generating a first acoustic signal to be presented to the user of the hearing aid 304. The first acoustic signal comprises at least a first part being generated in response to the first audio signal. The delay unit 6 is configured for applying a delay, such that synchronization of the at least first part of the first acoustic signal to the video display is improved.

The delay unit 6 of the system 302 is situated outside the hearing aid 304. Thus, the first acoustic signal received by the hearing aid will already have been delayed, thus synchronization may have been improved.

Figure 4:
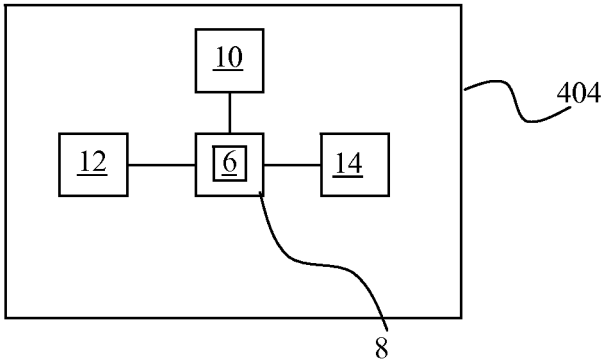
FIG. 4 schematically illustrates a fourth embodiment of a hearing aid.

FIG. 4 schematically illustrates a fourth embodiment of a hearing aid 404. The hearing aid 404 is configured for improving synchronization of an acoustic signal to a video display (not illustrated). The hearing aid 404 comprises a hearing loss processor 8 configured for processing in accordance with a hearing loss of a user of the hearing aid. The hearing aid 404 is configured for receiving a first audio signal being intended for synchronous presentation to a viewer of the video display. The hearing aid 404 is configured for generating a first acoustic signal to be presented to the user of the hearing aid. The first acoustic signal comprises at least a first part being generated in response to the first audio signal. The hearing aid comprises a delay unit 6 configured for applying a delay, such that synchronization of the at least first part of the first acoustic signal to the video display is improved. The hearing aid 404 comprises a first microphone 12 and a receiver (alternatively denoted speaker or loudspeaker) 14. The receiver 14 is configured for generating the first acoustic signal. The hearing aid 404 comprises a communication unit 10 configured for receiving the first audio signal. The communication unit 10 is configured for wireless communication. The wireless communication comprises at least receiving the first audio signal. The delay unit 6 is included in the hearing loss processor 8 of the hearing aid 404.

Figure 5:
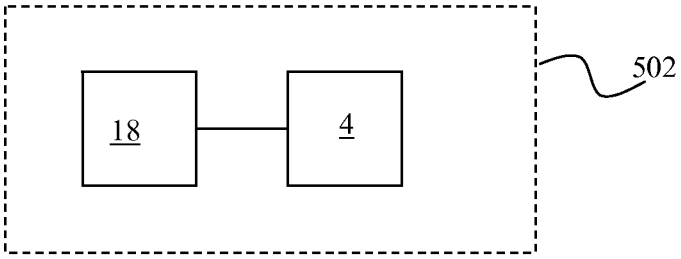
FIG. 5 schematically illustrates a fourth embodiment of a system.

FIG. 5 schematically illustrates a fourth embodiment of a system 502. In addition to what is described in connection to the system 2 of FIG. 1, the system 502 comprises an intermediate unit 18 configured for receiving a second audio signal intended for synchronous presentation to a viewer of the video display. The intermediate unit 18 is configured for transmitting the first audio signal in response to the received second audio signal.

Figure 6:
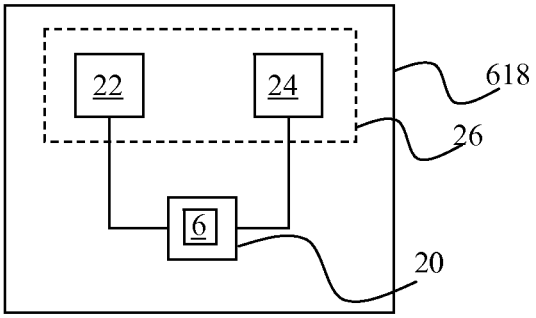
FIG. 6 schematically illustrates an embodiment of an intermediate unit.

FIG. 6 schematically illustrates an embodiment of the intermediate unit 618, wherein the delay unit 6 forms part of the intermediate unit 618. The intermediate unit 18 comprises a processor 20, a receiver (i.e. a signal receiving unit) 22, and a transmitter 24. The receiver 22 and the transmitter 24 may be integrated in a transceiver 26. The receiver 22 is configured for receiving the second audio signal. The transmitter 24 is configured for transmitting the first audio signal. The processor 20 incorporates the delay unit 20 and is configured for applying a delay.

Figure 7:
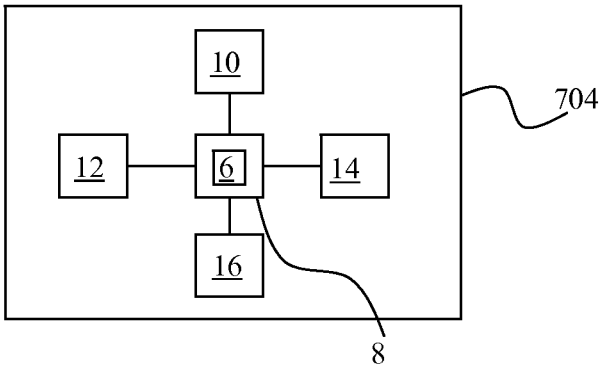
FIG. 7 schematically illustrates a fifth embodiment of a hearing aid.

FIG. 7 schematically illustrates a fifth embodiment of a hearing aid 704. In addition to what is described in connection to the hearing aid 404 of FIG. 4, the hearing aid 704 comprises a control interface 16 configured for enabling the user of the hearing aid 704 to control the delay. Thus, the control interface 16 forms part of the hearing aid 704. In one or more alternative embodiments, the control interface may be configured for controlling a delay unit situated outside the hearing aid, which hearing aid may or may not comprise a delay unit.

Thus, a system according to one or more embodiments comprises the hearing aid, wherein the system or the hearing aid comprises a control interface configured for enabling the user of the hearing aid to control the delay.

Figure 8:
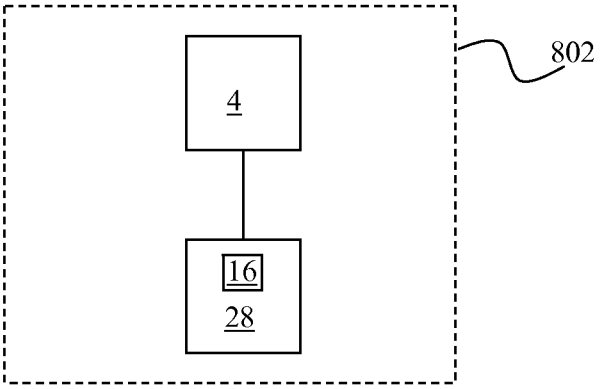
FIG. 8 schematically illustrates a fifth embodiment of a system.

FIG. 8 schematically illustrates a fifth embodiment of a system 802. In addition to what is described in connection to the system 2 of FIG. 1, the system 802 comprises a control interface 16 configured for enabling the user of the hearing aid to control the delay. The control interface 16 forms part of an auxiliary device 28 configured for remote control of the delay. The auxiliary device 28 may be considered to form part of the system 802. Alternatively, any parts of the auxiliary device 28 that are not specifically related to the control interface 16 are not considered part of the system 802. This may be the case for a software program running on e.g. a smart phone, where only the specific software program may be considered part of the system 802.

Figure 9:
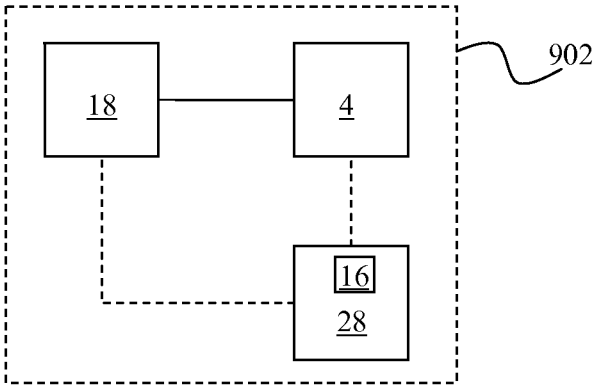
FIG. 9 schematically illustrates a sixth embodiment of a system.

FIG. 9 schematically illustrates a sixth embodiment of a system 902. The system 902 is a combination of the systems 502 and 802, where however, the communication the auxiliary device 28 to the hearing aid 4 may be in form of a communication from the auxiliary device 28 to the intermediate unit 18 instead, or from the auxiliary device 28 to both the hearing aid 4 and the intermediate unit 18. This is indicated by the dashed lines, which represents that communication is by either the one signal way, or the other, or both. The communication may be a wireless electromagnetic communication.

Figure 10:
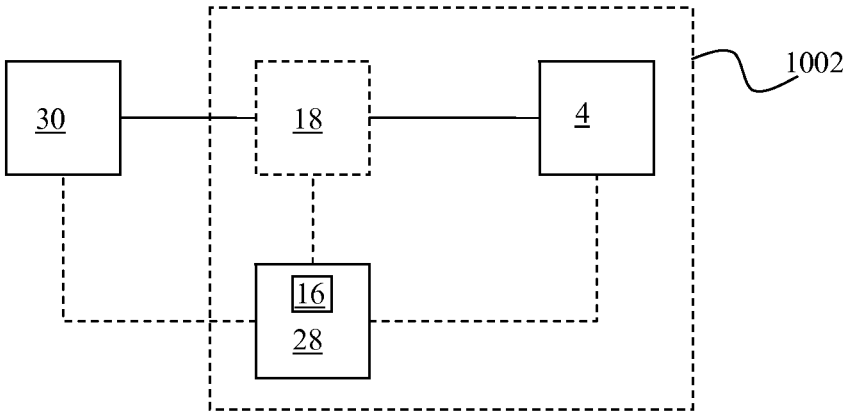
FIG. 10 schematically illustrates a seventh embodiment of a system.

FIG. 10 schematically illustrates a seventh embodiment of a system 1002. In addition to what is described in connection to the system 902 of FIG. 9, the system 1002, i.e. control interface 16, may be used to control the delay via the signal emitter 30, e.g. a TV set, transmitting the second audio signal to the intermediate unit 18, or transmitting the first audio signal directly to the hearing aid, e.g. to a system not including the intermediate unit 18.

Figure 11:
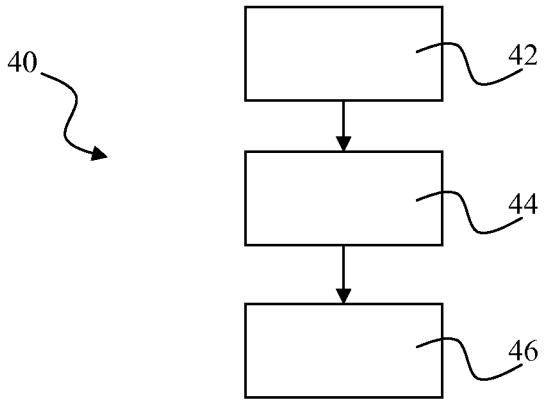
FIG. 11 schematically illustrates a first embodiment of a method.

FIG. 11 schematically illustrates a first embodiment of a method 40 for improving synchronization of an acoustic signal to a video display. The method 40 comprises receiving 42 a first audio signal by a hearing aid. The first audio signal is intended for synchronous presentation to a viewer of the video display. The hearing aid comprises a hearing loss processor configured for processing in accordance with a hearing loss of a user of the hearing aid. The method 40 comprises applying 44 a delay, such that synchronization of the at least first part of the first acoustic signal to the video display is improved. The method 40 comprises generating 46 a first acoustic signal by the hearing aid. The first acoustic signal is presented to the user of the hearing aid. The first acoustic signal comprises at least a first part being generated in response to the first audio signal.

Figure 12:
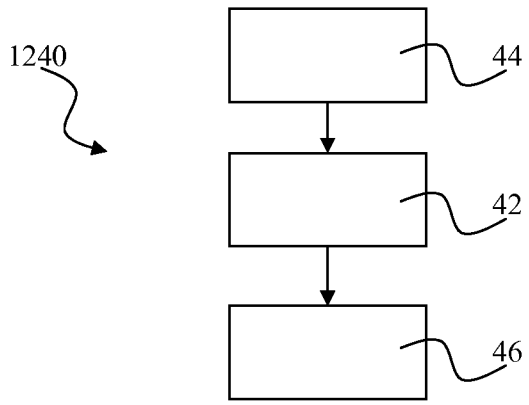
FIG. 12 schematically illustrates a second embodiment of a method.

FIG. 12 schematically illustrates a second embodiment of a method 1240 for improving synchronization of an acoustic signal to a video display. The method 1240 comprises applying 44 a delay, such that synchronization of the at least first part of the first acoustic signal to the video display is improved. The method 1240 comprises receiving 42 a first audio signal by a hearing aid. The first audio signal is intended for synchronous presentation to a viewer of the video display. The hearing aid comprises a hearing loss processor configured for processing in accordance with a hearing loss of a user of the hearing aid. The method 1240 comprises generating 46 a first acoustic signal by the hearing aid. The first acoustic signal is presented to the user of the hearing aid. The first acoustic signal comprises at least a first part being generated in response to the first audio signal.

Figure 13:
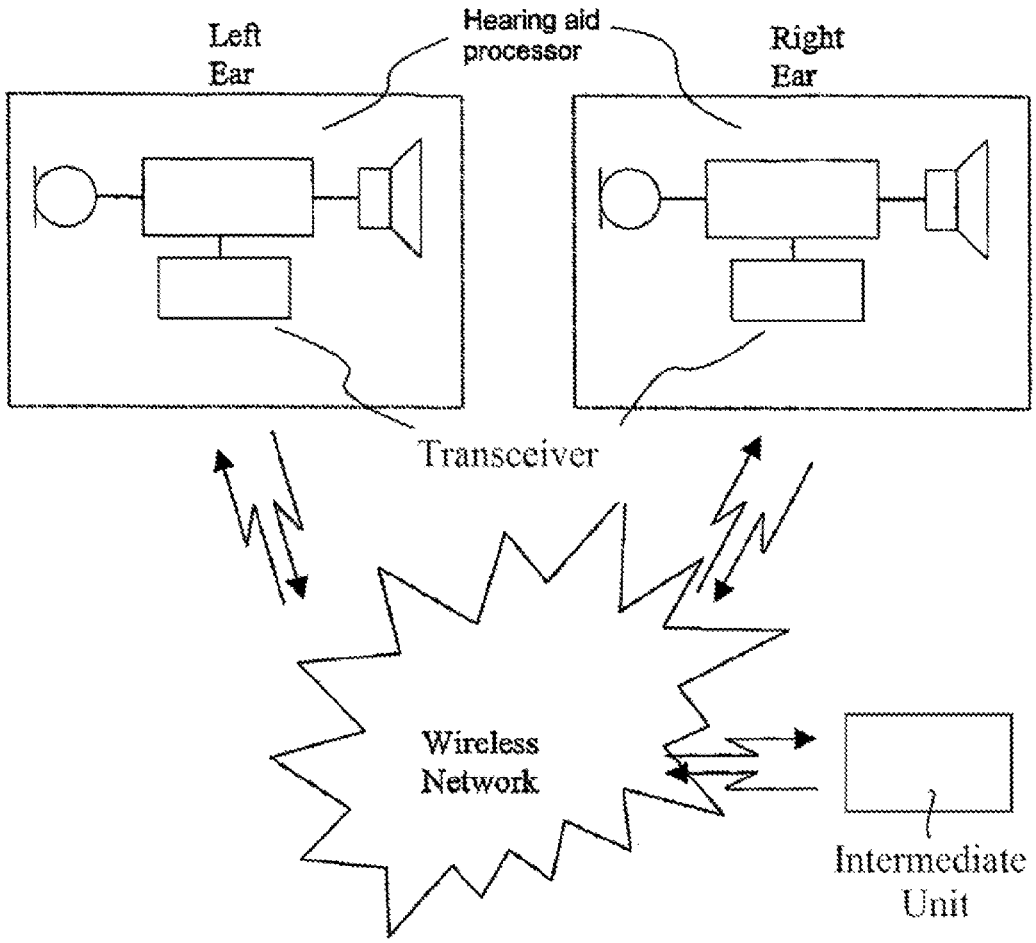
FIG. 13 schematically illustrates an embodiment of a system, wherein the system comprises a binaural hearing aid system.

FIG. 13 schematically illustrates an embodiment of a system, wherein the system comprises a binaural hearing aid system. The system comprises a binaural hearing aid system comprises the two hearing aids indicated by "left ear" and "right ear". Each hearing aid comprises a hearing aid processor (i.e. a hearing loss processor) and a transceiver that comprises a communication unit. Each transceiver may receive the first acoustic signal from a wireless network (i.e. e.g. a protocol) that may be generated by the intermediate unit.

The hearing aid 4 may be constituted by any of the hearing aids 204, 304, 404, and 704. The hearing aid 204 may be constituted by any of the hearing aids 404, and 704. The intermediate unit 18 may be constituted by the intermediate unit 618.

Although particular embodiments have been shown and described, it will be understood that they are not intended to limit the scope of the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2, 202, 302, 502, 802, 902, 1002: System
4, 204, 304, 404, 704: Hearing aid
6: Delay unit
8: Processor in hearing aid
10: Communication unit (e.g. for wireless communication)
12: Microphone
14: Receiver (speaker)
16: Control interface
18, 618: Intermediate unit
20: Processor in intermediate unit
22: Receiver (signal receiving unit)
24: Transmitter
26: Transceiver
28: Auxiliary device
30: Extern audio signal provider
40, 1240: Method
42: Receiving a first audio signal
44: Applying a delay
46: Generating a first acoustic signal

The invention claimed is:

1. A system for improving synchronization of an acoustic signal to a video display provided by a media device, the system comprising:

a hearing aid comprising a hearing loss processor configured for signal processing in accordance with a hearing loss of a user of the hearing aid, the hearing aid being configured for receiving a first audio signal for synchronous presentation to the user viewing the video display, the hearing aid being configured for generating a first acoustic signal to be presented to the user of the hearing aid, the first acoustic signal comprising at least a first part being generated in response to the first audio signal; and a delay unit that is physically separated from the media device, the delay unit configured for applying a delay to the first audio signal based at least in part on a control signal generated by a remote control, such that synchronization of the at least the first part of the first acoustic signal to the video display is improved, wherein the control signal is associated with a user input.

2. The system according to claim 1, further comprising a control interface configured for enabling the user of the hearing aid to control the delay.

3. The system according to claim 2, wherein the control interface is at the remote control for remote control of the delay.

4. The system according to claim 1, wherein the system is configured for provision of an automatic control of the delay by improving synchronization of the at least first part of the first acoustic signal to a second acoustic signal received by at least one microphone of the system.

5. The system according to claim 1, wherein the delay comprises a preset value.

6. The system according to claim 1, wherein the system comprises an intermediate unit configured for receiving a second audio signal for synchronous presentation to the user viewing the video display, the intermediate unit being configured for transmitting the first audio signal in response to the received second audio signal.

7. The system according to claim 6, wherein the delay unit forms part of the intermediate unit.

8. The system according to claim 1, wherein the delay unit forms part of the hearing aid.

9. The system according to claim 1, comprising a binaural hearing aid system, the binaural hearing aid system including the hearing aid and an additional hearing aid.

10. The system according to claim 1, wherein the remote control is implemented at a phone.

11. The system according to claim 1, wherein the first audio signal, before the delay is applied by the delay unit, is out of synchronization with respect to the video display due at least in part to a wireless transmission path between a source of the first audio signal and the hearing aid.

12. The system according to claim 1, wherein the delay unit is configured to apply the delay after the first audio signal is transmitted wirelessly from the media device.

13. A hearing aid configured for improving synchronization of an acoustic signal to a video display provided by a media system, the hearing aid comprising:

a hearing loss processor configured for signal processing in accordance with a hearing loss of a user of the hearing aid, the hearing aid being configured for receiving a first audio signal being for synchronous presentation to the user viewing the video display, the hearing aid being configured for generating a first acoustic signal to be presented to the user of the hearing aid, the first acoustic signal comprising at least a first part being generated in response to the first audio signal; and a control at the hearing aid configured to provide a control signal to a delay unit, the delay unit being physically separated from the media system, the delay unit configured for applying a delay to the first audio signal based at least in part on the control signal, such that synchronization of the at least first part of the first acoustic signal to the video display is improved, wherein the control signal is associated with a user input.

14. The hearing aid according to claim 13, further comprising the delay unit.

15. The hearing aid according to claim 13, wherein the first audio signal, before the delay is applied by the delay unit, is out of synchronization with respect to the video display due at least in part to a wireless transmission path between a source of the first audio signal and the hearing aid.

16. The hearing aid according to claim 13, wherein the delay unit is configured to apply the delay after the first audio signal is transmitted wirelessly from the media system.

17. A method for improving synchronization of an acoustic signal to a video display provided by a media system, comprising:

receiving a first audio signal by a hearing aid, the first audio signal being for synchronous presentation to a user of the hearing aid viewing the video display, the hearing aid comprising a hearing loss processor configured for signal processing in accordance with a hearing loss of the user of the hearing aid;

generating a first acoustic signal by the hearing aid, the first acoustic signal being presented to the user of the hearing aid, the first acoustic signal comprising at least a first part being generated in response to the first audio signal; and applying a delay to the first audio signal based at least in part on a control signal generated by a remote control or from the hearing aid, such that synchronization of the at least first part of the first acoustic signal to the video display is improved, wherein the control signal is associated with a user input, wherein the delay is applied by a delay unit that is physically separated from the media system.

18. The method according to claim 17, wherein the delay is controllable by the user.

19. The method according to claim 18, wherein the delay is controllable in steps of at least 10 ms.

20. The method according to claim 17, wherein the delay is automatic controlled by improving synchronization of the at least first part of the first acoustic signal to a second acoustic signal received by at least one microphone.

21. The method of claim 17, wherein the remote control is implanted at a phone.

22. The method according to claim 17, wherein the first audio signal, before the delay is applied by the delay unit, is out of synchronization with respect to the video display due at least in part to a wireless transmission path between a source of the first audio signal and the hearing aid.

23. The method according to claim 17, wherein the delay is applied by the delay unit after the first audio signal is transmitted wirelessly from the media system.

* * * * *